United States Patent [19]

Kozak et al.

[11] Patent Number: 4,768,922

[45] Date of Patent: Sep. 6, 1988

[54] VARIABLE STATOR AND SHROUD ASSEMBLY

[75] Inventors: Andrew A. Kozak, Canton, Mass.; George Minkkinen, Fairfield, Conn.

[73] Assignee: Avco Corporation, Providence, R.I.

[21] Appl. No.: 907,902

[22] Filed: Sep. 15, 1986

[51] Int. Cl.[4] ..... F01D 17/14

[52] U.S. Cl. ..... 415/160; 415/162

[58] Field of Search ..... 415/139, 160, 159, 161, 415/162

[56] References Cited

U.S. PATENT DOCUMENTS 3,736,070 5/1973 Moskowitz et al. ..... 415/160

OTHER PUBLICATIONS

"Research on a High Work Axial Gas Generator Turbine", by Patel, Society of Automative Engineers, 1980.

"Cold-Air Performance of A 12.776 Centimeter Tip Diameter Axial Flow Cooled Turbine" by Haas and Kofskey, NASA TP 1032, Sep. 1977.

*Primary Examiner*—Larry I. Schwartz

*Attorney, Agent, or Firm*—Perman & Green

[57] ABSTRACT

A variable stator assembly is provided for a gas turbine engine. The assembly comprises at least one winglet disposed on the radially inner end of each variable stator blade and/or on the radially outer end of each variable stator blade. The assembly further comprises at least one shroud disposed substantially adjacent and parallel to the associated winglet and within the flow path relative to the winglet. In a preferred embodiment, the assembly comprises both inner and outer winglets and inner and outer shrouds, with the shrouds being disposed intermediate the pair of winglets. The downstream edge of the shroud is configured to be substantially adjacent to the upstream edge of each variable stator blade through the full range of movement of each variable stator blade. Additionally, the shroud extends into the flow path between adjacent variable stator blades.

14 Claims, 3 Drawing Sheets

VARIABLE STATOR AND SHROUD ASSEMBLY

BACKGROUND OF THE INVENTION

Gas turbine engines produce power by burning fuel in the presence of compressed air and then directing the resulting combustion gases through rotatable arrays of turbine blades. Each rotatable array of turbine blades is preceded by a non-rotatable array of blades which directs the combustion gases into the rotatable array of blades at an optimum angle. The preferred angle of impingement of the combustion gases on the rotatable array of blades is a function of the rotational speed and/or power to be produced by the engine.

The efficiency of the gas turbine engine also is determined by the proportion of the combustion gases that actually perform work by impinging upon the rotating arrays of blades, or rotors. More particularly, some of the combustion gases will pass through the gaps between the stationary and moving parts. These gaps must be present in view of the different expansion characteristics exhibited by the various rotating and non-rotating parts of the engine. Considerable work has been done to minimize the tip losses, or losses which occur due to the flow of combustion gases between the tips of the rotor blades and the adjacent non-rotating structures. For example, the prior art has included honeycomb seals mounted on either the rotating or non-rotating member. The cells of the honeycomb structure are aligned in a generally radial direction with respect to the rotational axis of the turbine engine. It has been found that the presence of this honeycomb structure creates a turbulent air flow which cuts down on tip losses. Similarly, some turbine engines include knife-edge seals formed from generally annular rings mounted in offset relationship to both the rotating and non-rotating members of the engine. These offset annular members define a convoluted path through which air must travel, thereby creating localized pressure drops and turbulence which again minimize tip losses.

As noted above, efficiency is also affected by the angle at which the combustion gases impinge upon the turbine rotors. The angle of impingement for obtaining optimum efficiency will vary in accordance with the operating speed of the engine. Gas turbine engines that are employed in aircraft operate at or near the maximum speed most of the time. Consequently, for most operating conditions, there will be little variation in the optimum angle of impingement of the combustion gases on the rotor blades. As a result, the stator blades are fixedly mounted in the engine to direct the combustion gases toward the rotor at an angle that will achieve optimum efficiency during high power engine operating conditions.

Gas turbine engines provide a power to weight ratio that is desirable for many ground vehicles. Consequently, gas turbine engines are being used with increased frequency in certain ground vehicles, such as armored tanks, armored personnel carriers and trucks. The use of these engines in still other vehicles is possible. Much of the gas turbine technology developed for aircraft can be applied directly to ground vehicles. However, ground vehicles are likely to operate over a much broader range of engine speeds. Thus, in contrast to aircraft, ground vehicles are likely to spend a relatively large proportion of their time idling or at relatively low engine operating speeds. However, ground vehicles frequently will be called upon to operate efficiently at high engine speeds. In view of this wide range of engine operating conditions, some turbine powered ground vehicles employ variable stators which enable selective adjustments to the angles at which the combustion gases impinge upon the blades. More particularly, each stator blade is operative to selectively move about its own centerline which in turn extends substantially along or parallel to a radial line of the turbine engine. The stator blades will be adjusted in accordance with the engine operating speed in an effort to maximize fuel efficiency. Generally, at high engine speeds, the stator blades will be opened to permit a more direct axially aligned flow of combustion gases. At lower engine speeds, the stator blades will be closed somewhat.

The opposed radial ends of each variable stator blade include generally radially aligned pins about which the respective stator blades may pivot. At least one of the pins typically will include an appropriate structural means to effect the movement of the stator blade. For example, one pin of each stator blade may be provided with an array of gear teeth. The gear teeth may be mechanically interconected with other operable parts of the engine to effect the adjustments to the stator blade alignment with varying engine speeds.

The opposed radially inward and outward tips of each variable stator blade must be spaced from the stationary supports of the engine to enable these adjustments and to account for differential rates of thermal expansion. Typically, the sum of the radially inner and radially outer gaps will equal approximately 4% of the total radially extending space within which the variable stator is disposed. These radially inner and outer gaps can result in substantial tip losses, with a corresponding detrimental effect on engine operating efficiency. Thus, the improvements in efficiency that are attained by employing variable stators in a gas turbine engine are at least partly offset by the tip losses that result from the prior art variable stator blade.

The seals that have been developed in connection with turbine rotors can be applied to variable stators. However, the rotational movements inherent in the operation of turbine rotors have imposed certain limitations on the configuration and effectiveness of the seals for rotors.

In view of the above, it is an object of the subject invention to improve the efficiency of gas turbine engines.

It is another object of the subject invention to provide improved efficiency for gas turbine engines used in ground vehicles.

Another object of the subject invention is to provide a seal for reducing tip leakage in gas turbine engines.

An additional object of the subject invention is to provide an improved seal for variable stators of a gas turbine engine.

Still another object of the subject invention is to provide a seal for mounting adjacent the radially inner and/or the radially outer ends of the blades of a variable stator in a gas turbine engine.

SUMMARY OF THE INVENTION

The subject invention is directed to a seal for reducing tip losses through a variable stator in a gas turbine engine. More particularly, the seal of the subject invention enables a greater proportion of the combustion gases to be properly channelized by the variable stator blades to impinge upon the rotor blades at the proper angle. This decrease in the amount of combustion gases leaking past the tips of the variable stator blades results in a proportional improvement in engine efficiency.

The seal of the subject invention comprises a structure mounted to at least one opposed end of a variable stator blade. More particularly, the structure is fixedly mounted to an opposed end of a variable stator blade and extends generally orthogonal to a radial line extending along the length of the associated variable stator blade. The area defined by the structure mounted to the end of the variable stator blade is substantially greater than the area of the associated radial end of the stator blade. The structure mounted to the end of the variable stator blade preferably is fixedly mounted and will move with the stator blade as the blade undergoes variations in alignment in response to changes in engine speed. One such structure may be fixedly mounted to the radially outermost end of each variable stator blade, while another such structure may be mounted to the radially innermost portion of each variable stator blade.

The seal of the subject invention further comprises a shroud fixedly and non-rotatably mounted to the engine. The shroud is disposed within the flow path of the combustion gases and substantially adjacent to the structures mounted on the end of the variable stator blades. Thus, the shroud will be disposed radially inwardly from the structure mounted to the radially outermost portion of a variable stator blade. Similarly, the shroud will be disposed radially outwardly from a structure mounted to the radially innermost tip of a variable stator blade. The shape of the shroud will vary in accordance with the engine configuration. If the variable stator is disposed at a portion of the engine having substantially constant radial dimensions, the shroud may be generally annular and cylindrical in configuration. On the other hand, if the variable stator is disposed at a location in the engine where the radial dimensions are increasing or decreasing along an axial length of the engine, then the shroud may be of generally frusto-conical shape.

Preferably the shroud is disposed adjacent the upstream end of the variable stator. Additionally, it is preferred that the shroud and the structure mounted to the associated end of the variable stator blade be in overlapping relationship to one another.

The downstream end of the shroud may extend into the space between adjacent variable stator blades. Additionally, the downstream end of the shroud preferably is configured to be very close to the upstream end of the variable stator blades. The size of the small space between the shroud and the variable stator blades will be a function of the respective dimensional changes that are likely to occur to both the stator and the shroud in response to variations of pressure and temperature in the engine. However, as explained in detail above, each stator blade will rotate about its own centerline which typically is aligned along a radius of the engine. Consequently, both the upstream and downstream ends of each stator blade are likely to move significantly as the stator blade alignment is changed. As a result, the downstream end of the shroud may be configured to closely follow the locus of points formed by the upstream end of each stator blade as they move through their full range of variable alignments. The downstream end of the shroud may extend beyond this locus of points into the space between adjacent stator blades. Thus, the downstream end of the shroud may assume a generally scalloped configuration.

The combination of the above described shroud and the structure mounted to the end of each stator blade will define a convoluted path resulting in a substantial decrease in tip losses. As noted above, the radially innermost portion of the variable stator may include a shroud and structures mounted to the radially innermost ends of each stator blade, while the outermost portion of the stator will include another shroud and corresponding structures mounted to the outermost ends of each stator blade.

DETAILED DESCRIPTION OF THE PREFERRED EMBODIMENTS

Figure 1:
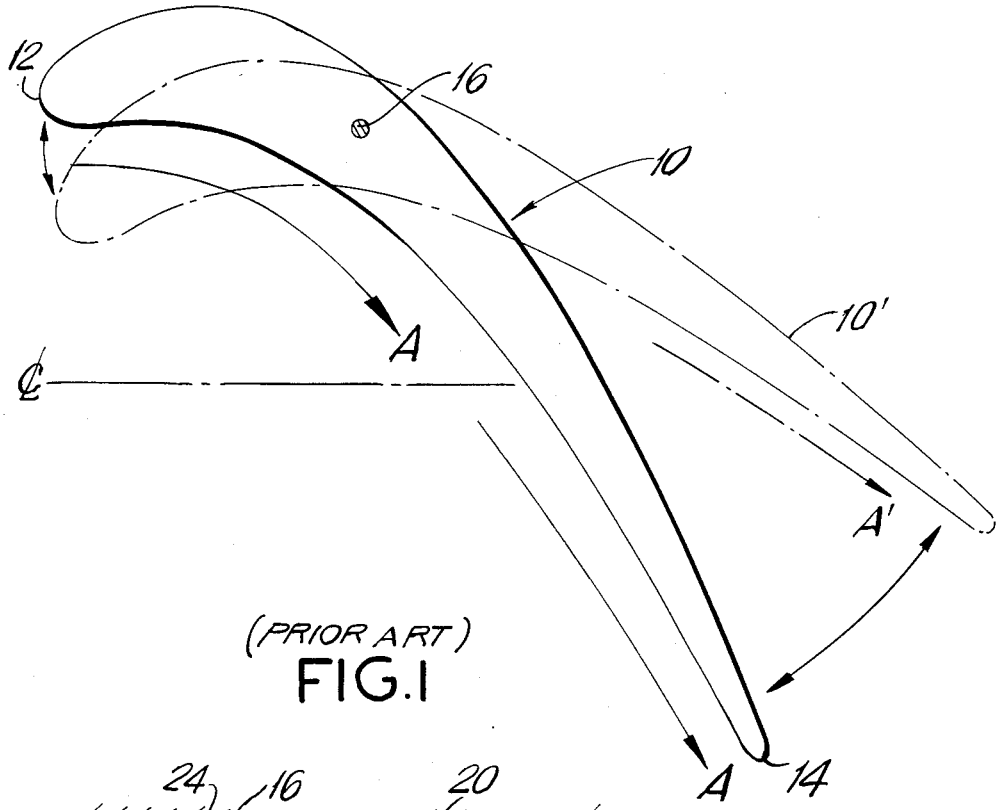
(PRIOR ART) FIG.1
FIG. 1 is a cross-sectional view of a prior art variable stator blade taken along a line perpendicular to a radius of the engine.
Figure 2:
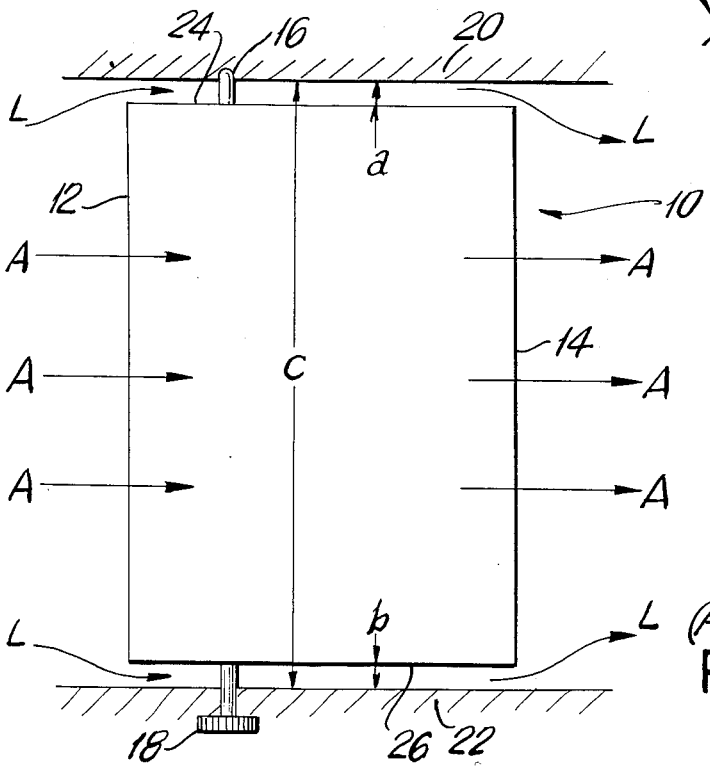
(PRIOR ART) FIG.2
FIG. 2 is a cross-sectional view of a prior art engine showing a single variable stator blade.

A prior art variable stator blade of a gas turbine engine is illustrated in FIGS. 1 and 2, and is identified generally by the numeral 10. The stator blade 10 is one of many stator blades which extend in generally radially outward directions from a location along the centerline of the turbine engine. The array of generally radially extending stator blades 10 is disposed upstream from a similarly configured array of generally radially aligned rotor blades (not shown). A plurality of alternating arrays of stator blades 10 and rotor blades may be disposed along the centerline of the turbine engine. Each array of rotor blades is operative to rotate about the centerline of the engine and thereby to produce power. The array of stator blades 10 does not rotate around the centerline of the engine. Rather, the stator blades merely function to change the direction of flow of combustion gases, indicated by arrows A in FIG. 1, as the combustion gases A pass from the upstream edge 12 of each stator blade to the downstream edge 14 thereof.

The object of each stator blade 12 is to insure that the combustion gases A impinge upon the downstream rotor at an angle that will achieve maximum efficiency for the engine. However, as noted above, this optimum angle for the impingement of combustion gases A upon the rotor will vary in accordance with the engine operating speeds and power demands. In view of this known relationship, gas turbine engines used in environments where power demands vary widely have employed the prior art variable stator 10 illustrated in FIGS. 1 and 2. The prior art variable stator 10 is operative to rotate about its own axis 16 which extends generally along a radius of the turbine engine. As illustrated most clearly in FIG. 1, the prior art variable stator blade 10 can move from a first position shown by the solid lines in FIG. 1 to a second position shown in broken lines and identified by the numeral 10'. In the first position, the prior art variable stator blade 10 would channelize the combustion gases as indicated generally by the arrows A. However, in the second position, the prior art variable stator blade 10' would channelize combustion gases in the general direction indicated by the arrow A'. The alignment indicated by the prior art variable stator blade 10' would be assumed for higher engine operating speeds. Conversely, the alignment indicated by the prior art variable stator blade 10 would be assumed for lower engine speeds. Changes in the alignment of the prior art variable stator blade 10 would be effected through a complex system of gears illustrated schematically by gear 18 in FIG. 2. Variations in alignment of the prior art variable stator blade could be effected by movements of the power lever for the engine.

As shown most clearly in FIG. 2, the prior art variable stator blade 10 necessarily had to be spaced from the structural members 20 and 22 to which the variable stator blade 10 was rotatably mounted. This spacing is indicated by gaps "a" and "b" which together typically would represent about 4% of the total radial distance "c" through which the combustion gases would travel. The gaps "a" and "b" would insure that the prior art variable stator blade 10 could move into different angular positions despite different rates of expansion and contraction under transient operating conditions. Although the gaps "a" and "b" were essential to the prior art variable stator blade 10, these gaps would result in substantial tip losses as indicated by the arrows L. More particularly, a significant portion of the combustion gases approaching the prior art variable stator blade 10 would pass around either the radially outer end 24 or the radially inner end 26 of the prior art variable stator blade 10. The combustion gases following the path indicated by arrows L would not impinge upon the downstream rotor at the optimum angle, and as a result the engine would operate at something less than maximum efficiency.

Figure 3:
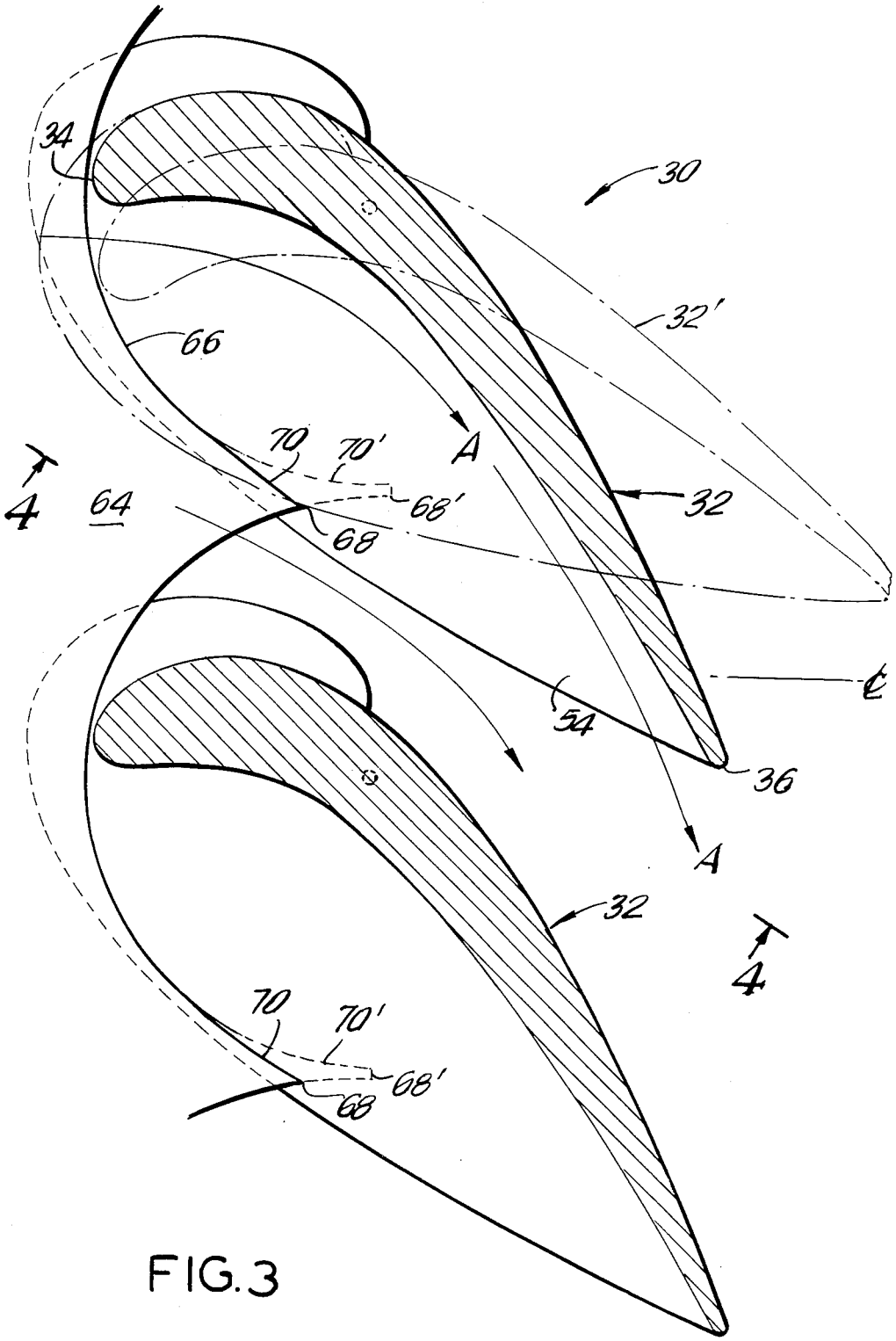
FIG. 3 is a cross-sectional view of the variable stator and shroud assembly of the subject invention.
Figure 4:
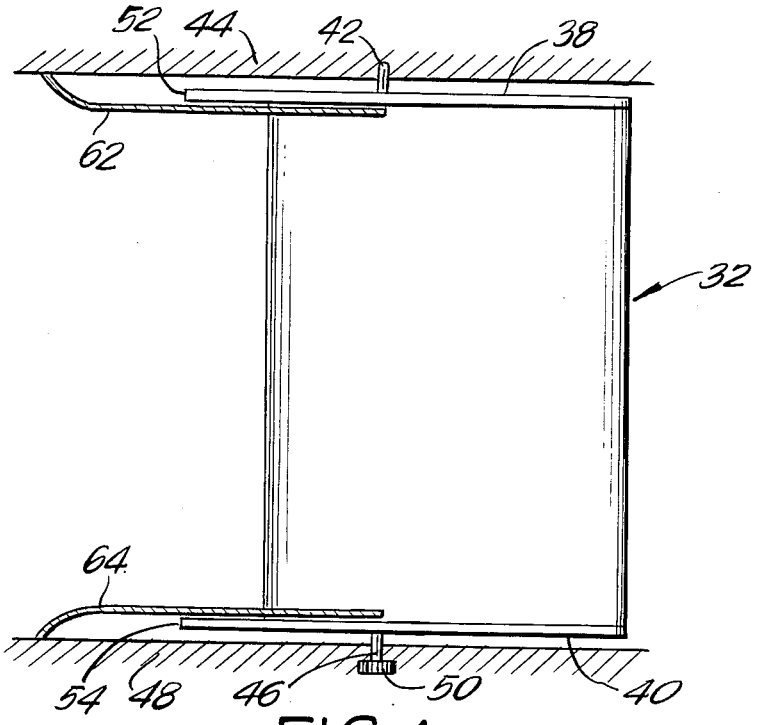
FIG. 4 is a cross-sectional view taken along line 4—4 in FIG. 3.

The variable stator assembly of the subject invention is illustrated in FIGS. 3 and 4 and is identified generally by the numeral 30. The variable stator assembly 30 of the subject invention includes a plurality of stator blades 32 each of which includes an upstream end 34 and a downstream end 36. Additionally, as shown in FIG. 4, the variable stator blade 32 includes a radially outer end 38 and a radially inner end 40. The radially outer end 38 includes a post 42 which is aligned generally along a radius of the turbine engine. The post 42 is pivotally mounted to a radially outer supporting surface 44 of the engine. Similarly, the radially innermost end of the variable stator blade 32 is provided with a post 46 pivotally mounted to a radially inwardly disposed supporting surface 48. The radially inwardly disposed post 46 also is provided with a gear 50 which engages with other gears in the power train to effect movement of the variable stator blade 32 about posts 42 and 46.

The radially outer and inner ends of the variable stator blade 32 are defined by winglets 52 and 54 respectively. The winglets 52 and 54 define an area substantially larger than the cross-sectional area of the variable stator blade taken intermediate the winglets 52 and 54. The exact shape of the winglets 52 and 54 will depend upon the operating characteristics of the engine. However, the winglets 52 and 54 extend upstream from the upstream end 34 of each variable stator 32. Additionally, as shown most clearly in FIG. 3, the winglets 52 and 54 will extend a substantial distance into the flow path between adjacent variable stator blades 32.

The variable stator assembly 30 of the subject invention further includes inner and outer shrouds 62 and 64 respectively. The radially outer shroud 62 is securely mounted to the turbine wall 44 as shown in FIG. 4. Similarly, the radially inner shroud 64 is securely mounted to the wall 48. The shrouds 62 and 64 extend into the flow path between the winglets 52 and 54. More particularly, the radially outer shroud 62 is disposed substantially adjacent and generally parallel to the radially outer winglet 52. Similarly, the radially inner shroud 64 is disposed substantially adjacent and generally parallel to the radially inner winglet 54. The spacing between each shroud 62 or 64 and its adjacent winglet 52 or 54 should be maintained at a minimum, but also should be sufficient to avoid contact or rubbing during transient operating conditions. The size of the gap between the shrouds 62 and 64 and the associated winglets 52 and 54 respectively will depend upon the specific operating conditions of the engine.

As shown most clearly in FIG. 3, the downstream edge 66 of the shroud 64 is substantially adjacent to the upstream edge 34 of the variable stator 32. Additionally, the downstream edge 66 of the shroud 64 is of generally scalloped configuration so as to extend into the space between adjacent variable stator blades 32. The specific scalloped configuration should insure that the upstream edge 34 of each variable stator blade 32 will be only slightly spaced from the downstream edge 66 of shroud 64 throughout the full range of movement of the variable stator blade 32. This relationship is shown most clearly in FIG. 3 wherein the downstream edge 66 of the shroud 64 is only slightly spaced from the upstream edge 34 of the variable stator blade 32 in a first position shown in solid lines. Additionally, this spacing remains essentially constant for the alignment of the variable stator blade shown in broken lines and indicated by the numeral 34'. Furthermore, the respective shapes of the shroud 64 and the winglet 54 are such that an overlapping relationship will exist throughout the full range of movement of the variable stator blade 32.

Points 68 are defined between the adjacent scalloped portions of the downstream edge 66 of shroud 64. The precise configuration of the downstream edge 66 adjacent the points 68 will have some small but measuring effect on tip losses, turbulence and engine efficiency. Preferably, the edge 70 leading into point 68 should substantially parallel the preferred direction of combustion gases produced by the variable stator blades 32. This preferred parallelism cannot occur under all conditions since the alignment of the variable stator blades 32 will change periodically. Therefore, the alignment of edge segment 70 leading into point 68 will depend upon the anticipated range of operating conditions for the turbine engine. If the engine will operate mostly at moderate speeds, the stator blades will be aligned substantially as shown by the solid lines of stator blade 32. Thus, the edge segment 70 will also be substantially as shown by the solid lines. However, if the engine will be employed at high speed conditions most of the time, the variable stator blades will assume the alignment indicated by the broken line stator blade 32'. In this situation, the downstream edge 66 of the shroud 64 may assume a configuration indicated by edge segment 70' and point 68'.

Figure 5:
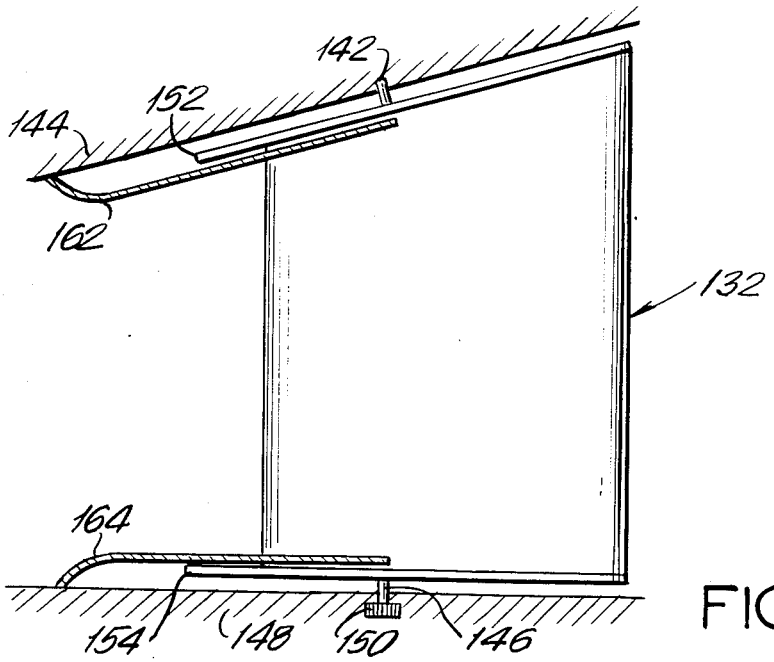
FIG. 5 is a cross-sectional view of an alternate variable stator and shroud of the subject invention.

The variable stator described and illustrated with reference to FIGS. 3 and 4 has assumed mounting in a portion of an engine that is of generally cylindrical configuration. In many situations, however, the variable stator will be positioned in a portion of the engine that is of generally frusto-conical configuration. One such possible configuration is illustrated in FIG. 5. More particularly, in this configuration the variable stator blade 132 is of generally trapezoidal configuration, and the winglets 152 and 154 are not parallel with respect to one another. However, the winglets 152 and 154 will still be substantially parallel to the adjacent walls structures 144 and 148 of the engine and will be pivotally mounted thereto by posts 142 and 146. Similarly, the alignment of the stator blade 132 may be varied through an interaction of the gear 150 with other operative parts of the engine. In this configuration, shrouds 162 and 164 are mounted respectively to the wall structures 144 and 148 respectively. Furthermore, the shrouds 162 and 164 will be disposed in the flow path between the winglets 152 and 154. Shroud 162 will be substantially parallel to and adjacent to the associated winglet 152. Similarly, the shroud 164 will be substantially parallel and adjacent to its associated winglet 154, as shown in FIG. 5. The configuration of the winglets 152 and 154 and the shrouds 162 and 164 will be substantially similar to the configurations shown in FIG. 3 for a cylindrical portion of the engine.

In summary, a variable stator assembly is provided for a gas turbine engine. The variable stator assembly includes an array of variable stator blades that extend generally radially outwardly from the centerline of the gas turbine engine. Each variable stator blade is adjustably mounted to move about its own axis which defines a radius of the turbine engine. Variations in the alignment of the stator blades will be effected by known means in accordance with variations in engine speed. Each stator blade includes a winglet disposed on its radially inner and radially outer extremes. The winglet defines an area substantially greater than the area of the stator blade at the point at which the winglet is mounted. The assembly further includes radially inner and radially outer shrouds that are disposed in the flow path of the combustion gases between the respective winglets. The shrouds are securely mounted to adjacent structural supports of the engine. The outer shroud is substantially adjacent and parallel to the outer winglet, while the inner shroud is substantially adjacent and parallel to the inner winglet. The downstream edge of each shroud is configured to be substantially adjacent to the upstream edge of the variable stator blade throughout the full range of movement of the variable stator blade. As a result, the downstream edge of the variable stator blade assumes a generally scalloped configuration.

While the invention has been described with respect to certain preferred embodiments, it is obvious that various changes can be made without departing from the scope of the invention as defined by the appended claims.

What is claimed is:

1. A variable stator assembly for a gas turbine engine, said variable stator assembly comprising:

a plurality of generally radially aligned variable stator blades, each said blade including opposed radially inner and radially outer ends and opposed upstream and downstream edges, said stator blades being adjustably mounted in the engine to rotate about an axis extending between the opposed inner and outer ends;

a winglet fixedly mounted to at least one of said inner and outer ends of each said stator blade and moveable therewith relative to the engine, said winglet extending upstream beyond the upstream edge of said stator blade; and at least one shroud fixedly mounted to the engine, said shroud including a downstream edge spaced slightly from the upstream edge of each said stator blade at a location intermediate said inner and outer ends of each said stator blade, the downstream edge of said shroud being configured such that portions of said shroud are disposed intermediate adjacent stator blades, whereby said winglets and said shroud channelize the flow of gases through said variable stator assembly.

2. As assembly as in claim 1 wherein each said stator blade includes an inner winglet fixedly secured to the inner end of said stator blade and an outer winglet fixedly secured to the outer end of each said blade.

3. An assembly as in claim 2 wherein said at least one shroud comprises an inner shroud disposed substantially adjacent to said inner winglets and an outer shroud disposed substantially adjacent said outer winglets.

4. An assembly as in claim 3 wherein the inner and outer shrouds include portions disposed substantially parallel to the respective inner and outer winglets.

5. An assembly as in claim 4 wherein the downstream edge of each said shroud is disposed further downstream than the upstream edges of said winglets for each adjustable position of said stator blade, such that the inner and outer shrouds are disposed in overlapping relationship with the respective inner and outer winglets.

6. An assembly as in claim 1 wherein each said stator blade is generally rectangular in shape.

7. An assembly as in claim 1 wherein each said stator blade is generally trapezoidal in shape.

8. A variable stator assembly for a gas turbine engine, said engine comprising a generally annular flow path for combustion gases, said variable stator assembly comprising:

a plurality of generally radially extending variable stator blades disposed in said flow path of said engine, each said blade including opposed upstream and downstream edges extending in generally radial directions relative to said engine, each said stator blade further including opposed radially inner and radially outer ends, each said stator blade being mounted in said flow path for controlled rotatable movement about an axis extending in a generally radial direction relative to the engine;

inner and outer winglets fixedly mounted to the respective inner and outer ends of each said stator blade and moveable therewith relative to the engine, each said winglet including an upstream edge disposed further upstream in the engine than the upstream edge of the associated variable stator blade, the inner and outer winglets being spaced from the inner and outer walls of the flow path thereby defining generally annular inner and outer gaps therebetween;

inner and outer shrouds fixedly mounted to the inner and outer walls respectively, said inner and outer shrouds each including downstream portions disposed substantially parallel and adjacent to portions of the respective inner and outer winglets, said downstream portions of said inner and outer shrouds being disposed intermediate the inner and outer winglets.

9. An assembly as in claim 8 wherein said inner and outer shrouds each include a downstream edge, said downstream edges being configured to be spaced slightly from the upstream edge of each said variable stator blade throughout the full range of movement for said variable stator blades.

10. An assembly as in claim 9 wherein the downstream portions of said inner and outer shrouds are configured to extend into the portion of the flow path intermediate adjacent ones of said variable stator blades.

11. An assembly as in claim 8 further comprising means for adjustably moving each of said variable stator blades.

12. An assembly as in claim 8 wherein the respective downstream edges of said inner and outer shrouds are of generally scalloped configuration.

13. An assembly as in claim 12 wherein the scalloped configuration of the respective downstream edges of said inner and outer shrouds defines points extending into the flow path between adjacent said variable stator blades.

14. As assembly as in claim 13 wherein a portion of the downstream edges of said inner and outer shrouds adjacent the points formed thereon is aligned generally parallel to a direction of flow of the combustion gases for a selected alignment of said variable stator blades.

* * * * *